US011141979B2

(12) United States Patent
Nakai et al.

(10) Patent No.: US 11,141,979 B2
(45) Date of Patent: Oct. 12, 2021

(54) INKJET PRINTING APPARATUS AND TREATMENT LIQUID HOLDING UNIT

(71) Applicant: CANON KABUSHIKI KAISHA, Tokyo (JP)

(72) Inventors: Hiroshi Nakai, Sagamihara (JP); Takahiro Kiuchi, Fuchu (JP); Noriko Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/955,813

(22) Filed: Apr. 18, 2018

(65) Prior Publication Data

US 2018/0311960 A1 Nov. 1, 2018

(30) Foreign Application Priority Data

May 1, 2017 (JP) ..... JP2017-091336

(51) Int. Cl.
*B41J 2/165* (2006.01)

(52) U.S. Cl.
CPC ..... *B41J 2/16541* (2013.01); *B41J 2/16538* (2013.01); *B41J 2/16552* (2013.01); *B41J 2002/16558* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,669,327 | B1 * | 12/2003 | Harper | B41J 2/16535 347/28 |
| 8,313,165 | B2 * | 11/2012 | Hibbard | B41J 2/16538 347/33 |
| 8,491,085 | B2 * | 7/2013 | Asano | B41J 2/16585 347/22 |
| 9,254,665 | B2 * | 2/2016 | Shinoto | B41J 2/16535 |
| 9,878,546 | B2 * | 1/2018 | Yamanobe | B41J 2/16535 |
| 10,086,615 | B2 * | 10/2018 | Nakano | B41J 2/16538 |
| 2009/0179946 | A1 * | 7/2009 | Hibbard | B41J 2/16547 347/33 |

(Continued)

FOREIGN PATENT DOCUMENTS

| | | |
|---|---|---|
| JP | 2009-023118 A | 2/2009 |
| JP | 2016043582 A | 4/2016 |

OTHER PUBLICATIONS

Copending, unpublished U.S. Appl. No. 15/955,005 to Takahiro Kiuchi et al., filed Apr. 17, 2018.

(Continued)

*Primary Examiner* — Alejandro Valencia
(74) *Attorney, Agent, or Firm* — Venable LLP

(57) ABSTRACT

An inkjet printing apparatus includes: a print head having an ejection opening surface on which an ejection opening for ejecting ink is provided; a wiping unit configured to wipe the ejection opening surface; a moving unit configured to move the wiping unit in a first direction; and a treatment liquid holding portion having a holding member for holding a treatment liquid and an applying member for applying the treatment liquid to the wiping unit by coming into contact with the wiping unit, wherein a plurality of treatment liquid holding portions are arranged in a second direction crossing the first direction such that adjacent treatment liquid holding portions are not in contact with each other.

14 Claims, 16 Drawing Sheets

(56) References Cited

U.S. PATENT DOCUMENTS

| | | | | |
|---|---|---|---|---|
| 2012/0038707 | A1* | 2/2012 | Maida | B41J 2/16541 347/33 |
| 2013/0088544 | A1 | 4/2013 | Ishimatsu | |
| 2013/0176362 | A1* | 7/2013 | Inoue | B41J 2/16535 347/33 |
| 2013/0187979 | A1* | 7/2013 | Bernard | B41J 2/16538 347/33 |
| 2014/0253632 | A1* | 9/2014 | Matsumoto | B41J 2/1652 347/33 |
| 2016/0052279 | A1 | 2/2016 | Saito et al. | |

OTHER PUBLICATIONS

Japanese Office Action, dated Nov. 10, 2020, in Japanese Application No. 2017-091336.

* cited by examiner

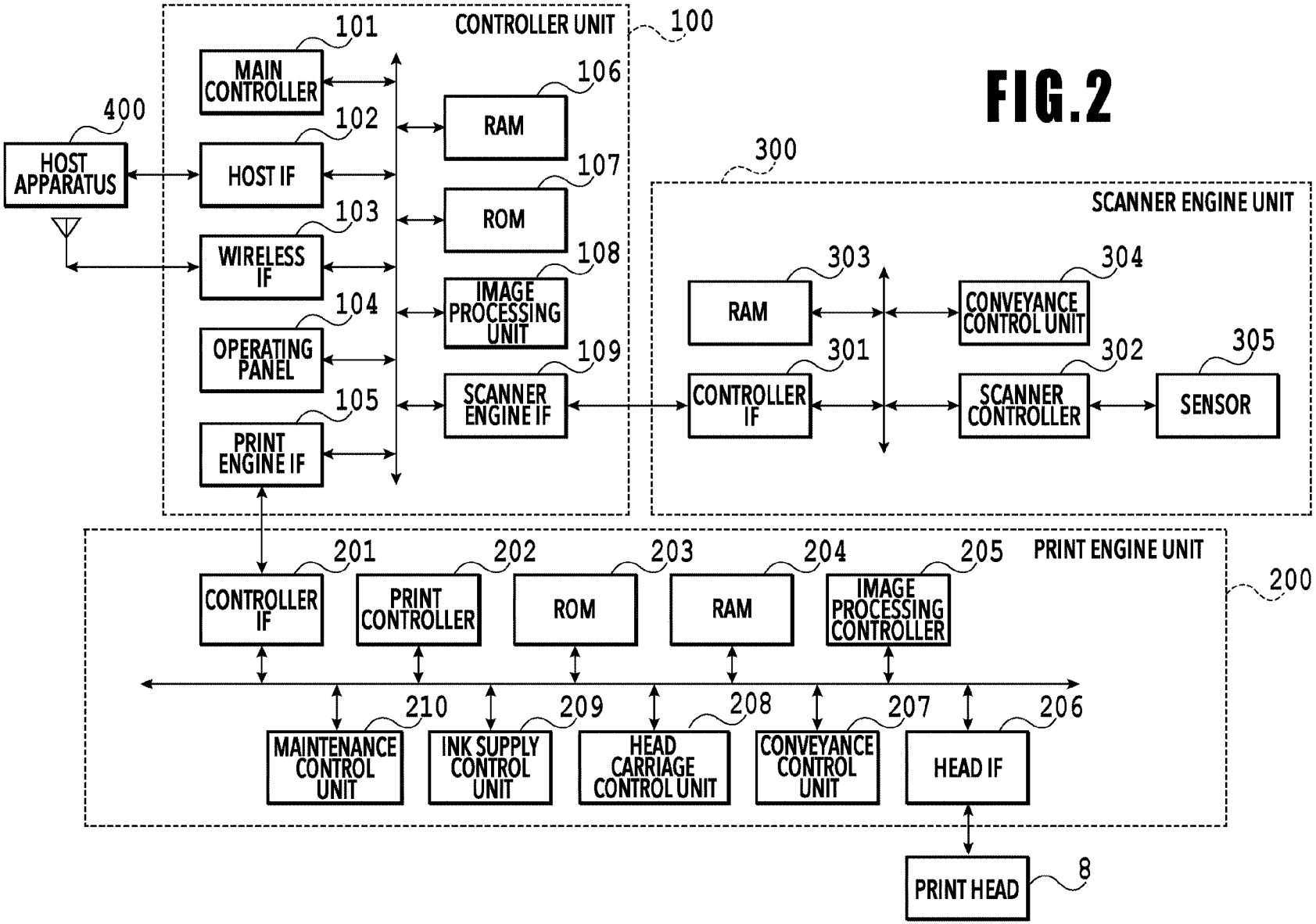
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSING UNIT
108
SCANNER ENGINE IF
109
HOST APPARATUS
400
SCANNER ENGINE UNIT
300
RAM
303
CONTROLLER IF
301
CONVEYANCE CONTROL UNIT
304
SCANNER CONTROLLER
302
SENSOR
305
PRINT ENGINE UNIT
200
CONTROLLER IF
201
PRINT CONTROLLER
202
ROM
203
RAM
204
IMAGE PROCESSING CONTROLLER
205
HEAD IF
206
CONVEYANCE CONTROL UNIT
207
HEAD CARRIAGE CONTROL UNIT
208
INK SUPPLY CONTROL UNIT
209
MAINTENANCE CONTROL UNIT
210
PRINT HEAD
8

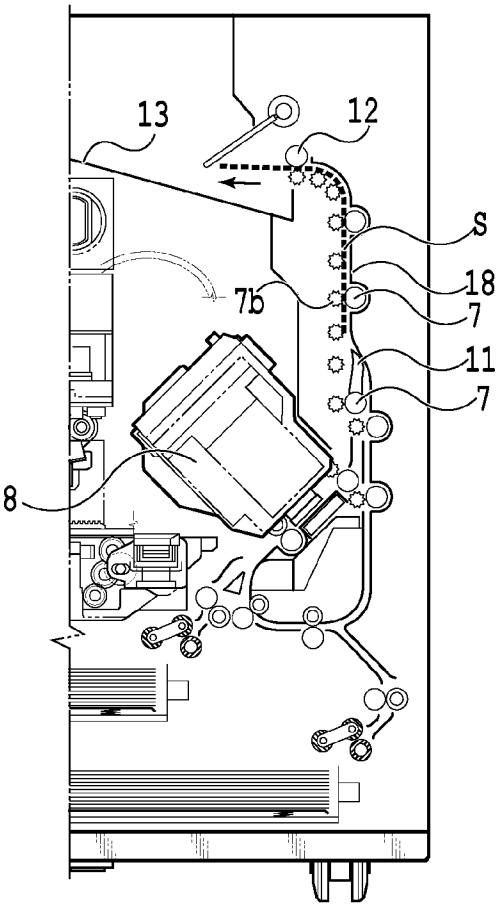
FIG.4C
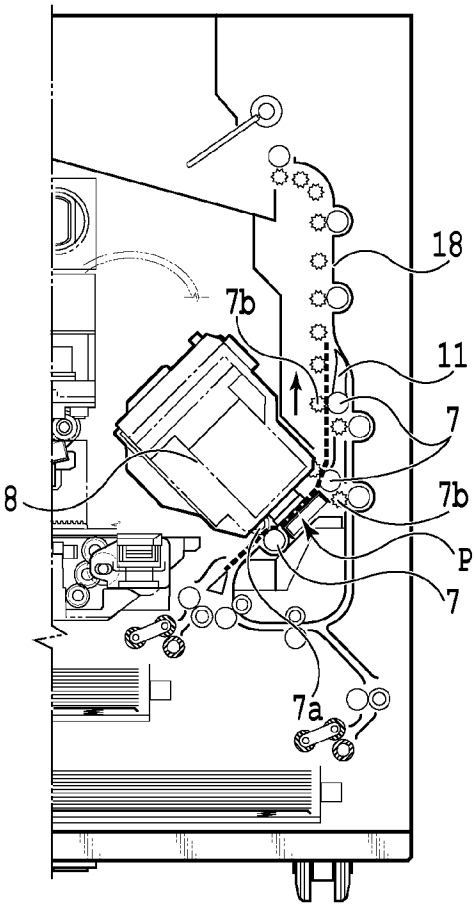
FIG.4B
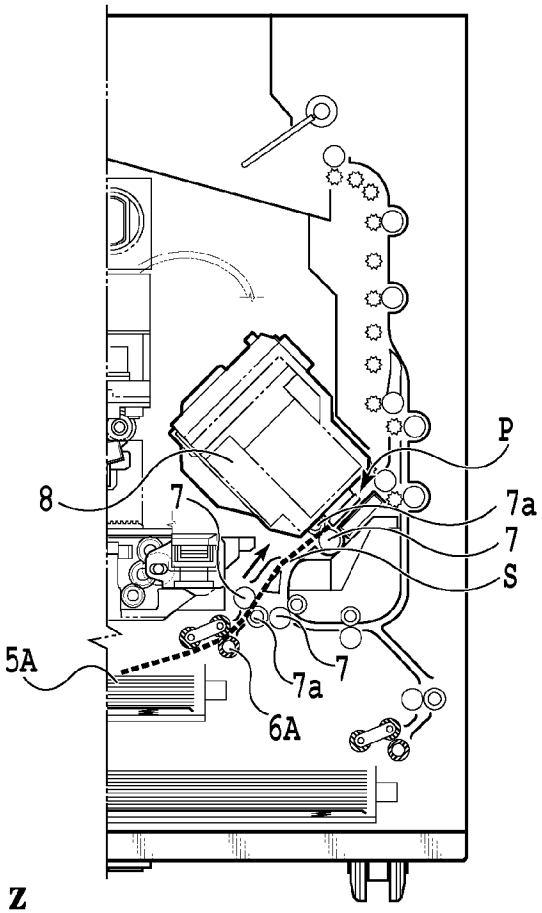
FIG.4A
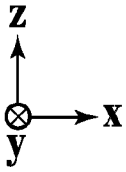

INKJET PRINTING APPARATUS AND TREATMENT LIQUID HOLDING UNIT

BACKGROUND OF THE INVENTION

Field of the Invention

The present invention relates to an inkjet printing apparatus and a treatment liquid holding unit.

Description of the Related Art

To clean an ejection opening surface of a print head of an inkjet printing apparatus, a wiping member is used. A treatment liquid is applied to the wiping member to maintain surface smoothness of the ejection opening surface and to improve sliding of the wiping member. Japanese Patent Laid-Open No. 2016-043582 (hereinafter referred to as PTL 1) discloses a wiper blade for cleaning the ejection opening surface of the print head which is reciprocated, and also a technique of enabling the separation of a member for holding a treatment liquid and a member for transferring the treatment liquid to the wiper blade.

The ejection opening surface of the print head (a so-called line head) having ejection openings corresponding to the size of the width of a print medium is cleaned by the wiping member driven in a lateral direction of the print head, so the wiping member is an elongate member corresponding to the width of the print head in its longitudinal direction. A treatment liquid holding unit that applies the treatment liquid to the wiping member by coming into contact with the driven wiping member is also an elongate member. In a case where the treatment liquid holding unit is elongated, change in a longitudinal position of the treatment liquid holding unit in a vertically upward or downward direction at the time of transport, component replacement, or the like may cause the treatment liquid to be transmitted and concentrated downward. As a result, the treatment liquid holding unit cannot hold the treatment liquid any longer, incurring the risk of leakage of the treatment liquid. PTL 1 discloses a technique of separating a member for holding a treatment liquid and a member for transferring the treatment liquid into two. However, in the treatment liquid holding unit having an elongate configuration, simply separating the member for holding the treatment liquid and the member for transferring the treatment liquid into two may still cause the treatment liquid to leak.

SUMMARY OF THE INVENTION

According to an aspect of the present invention, there is provided an inkjet printing apparatus including: a print head having an ejection opening surface on which an ejection opening for ejecting ink is provided; a wiping unit configured to wipe the ejection opening surface; a moving unit configured to move the wiping unit in a first direction; and a treatment liquid holding portion having a holding member for holding a treatment liquid and an applying member for applying the treatment liquid to the wiping unit by coming into contact with the wiping unit, wherein a plurality of treatment liquid holding portions are arranged in a second direction crossing the first direction such that adjacent treatment liquid holding portions are not in contact with each other.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 4A to 4C are conveying path diagrams of a print medium fed from a first cassette;

DESCRIPTION OF THE EMBODIMENTS

Figure 1:
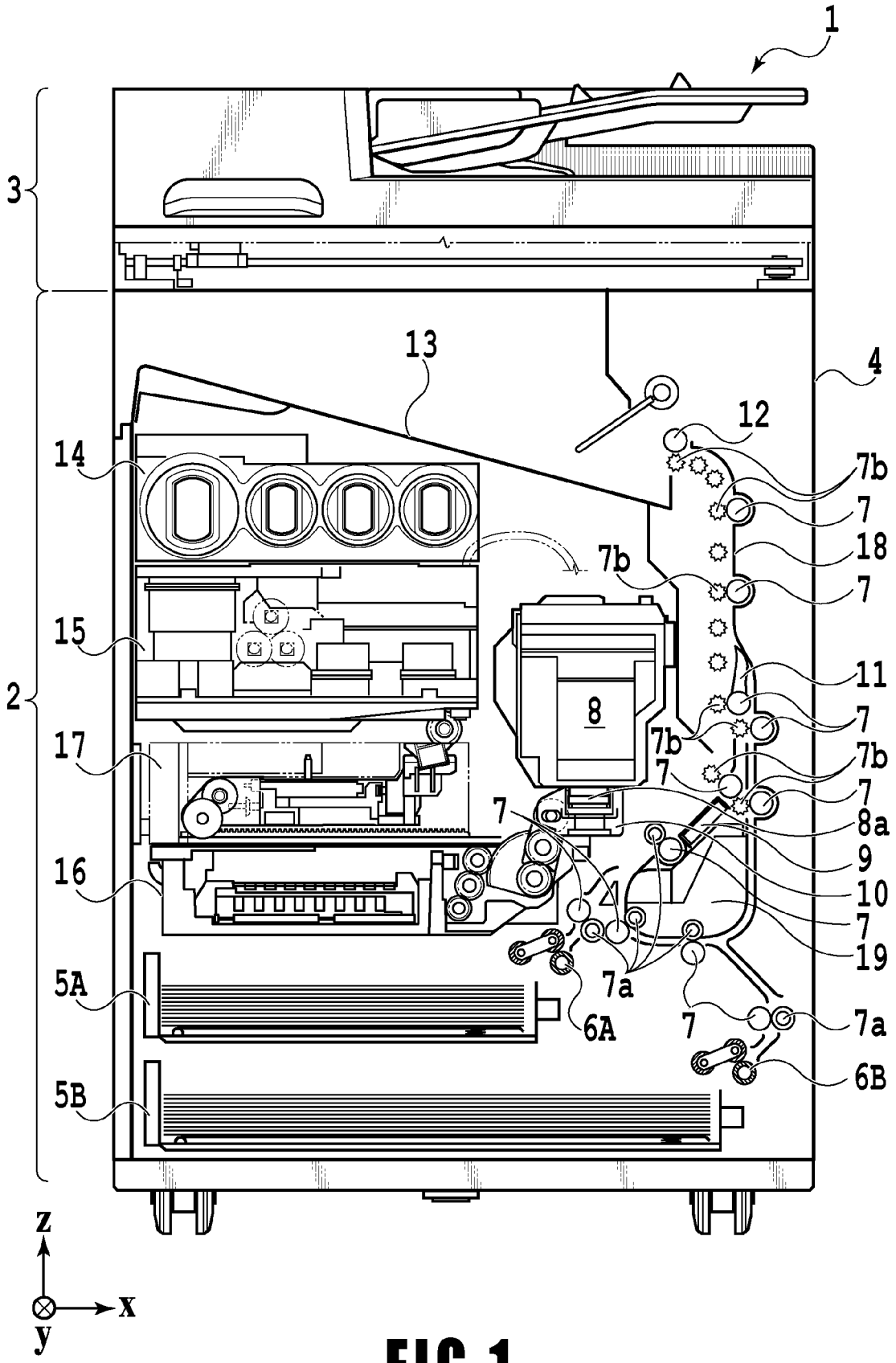
FIG. 1 is a diagram showing a printing apparatus in a standby state.

Embodiments of the present invention will be described with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following description. Furthermore, relative positions, shapes, and the like of the constituent elements described in the embodiments are exemplary only and are not intended to limit the scope of the invention.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RANI 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
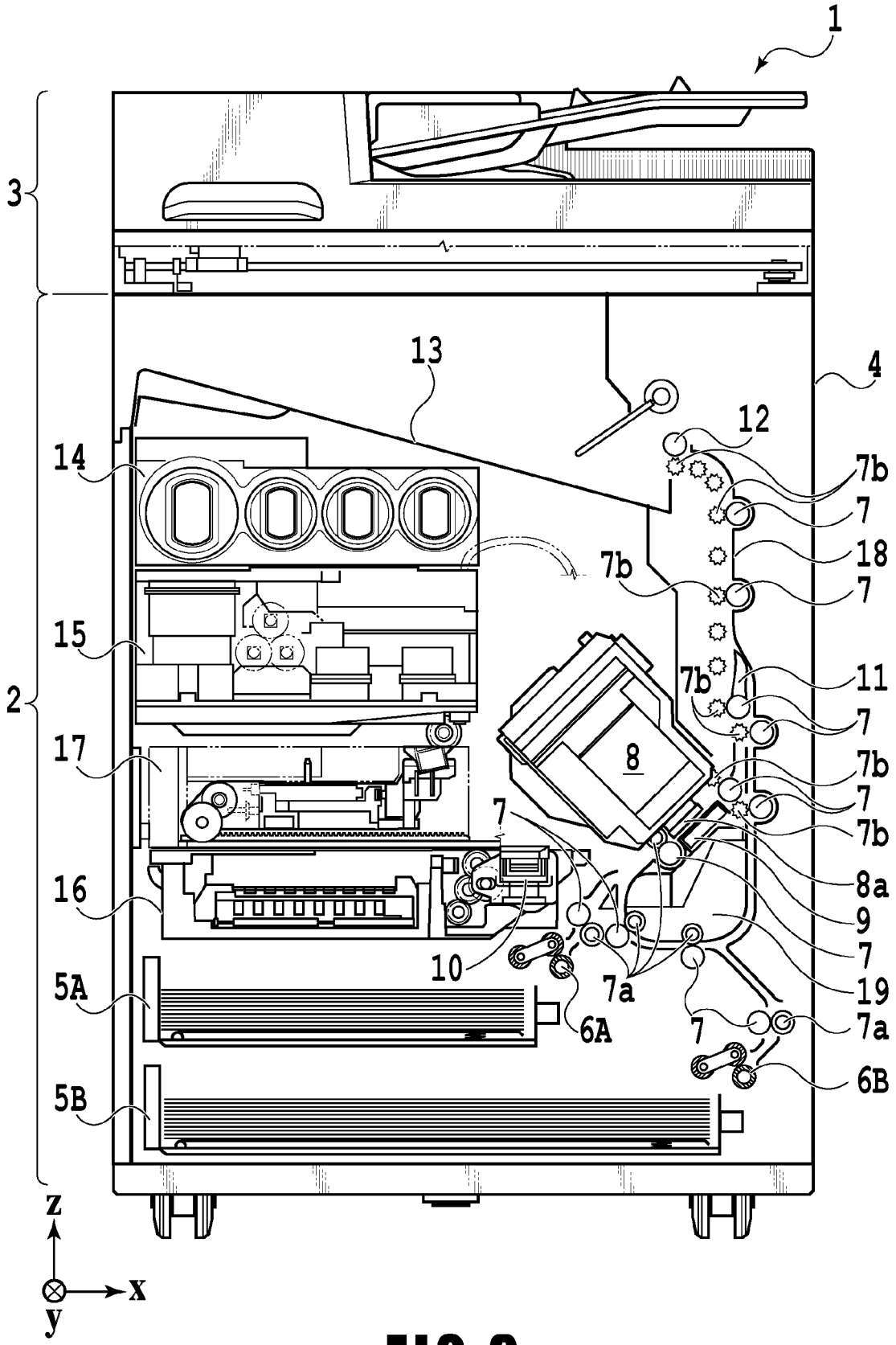
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
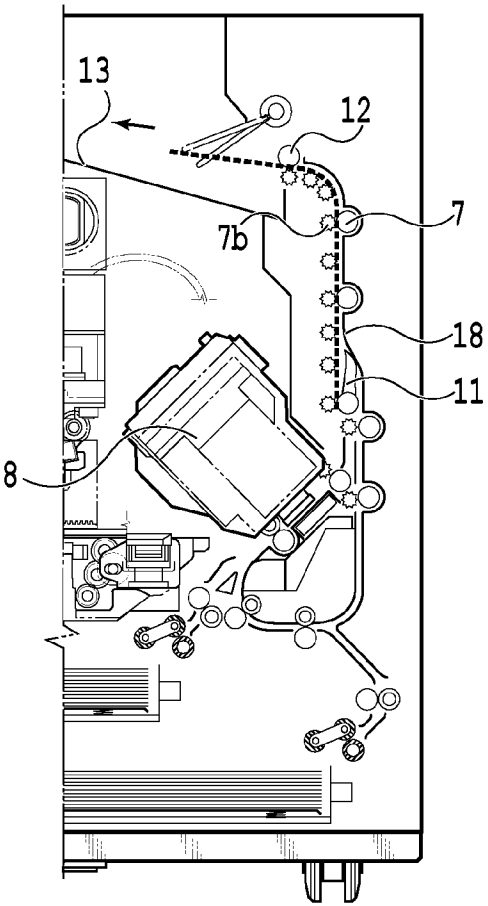
FIGS. 5A to 5C are conveying path diagrams of a print medium fed from a second cassette.
Figure 5B:
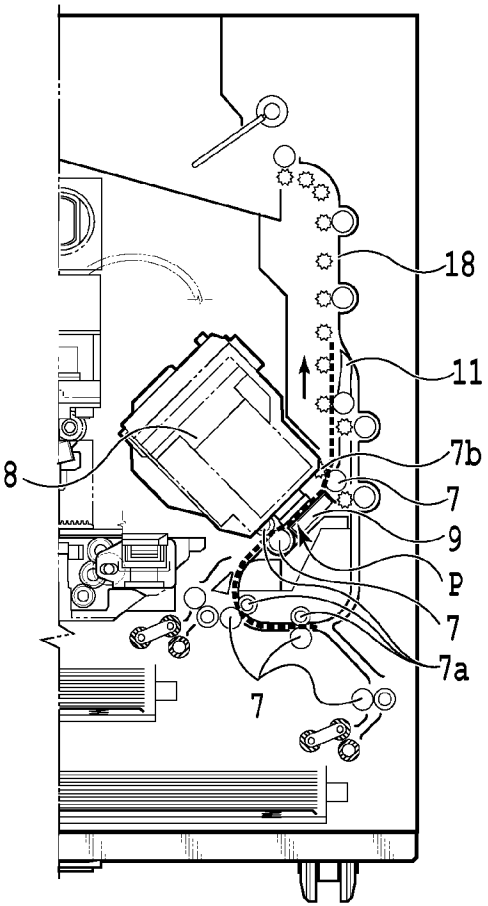
Figure 5A:
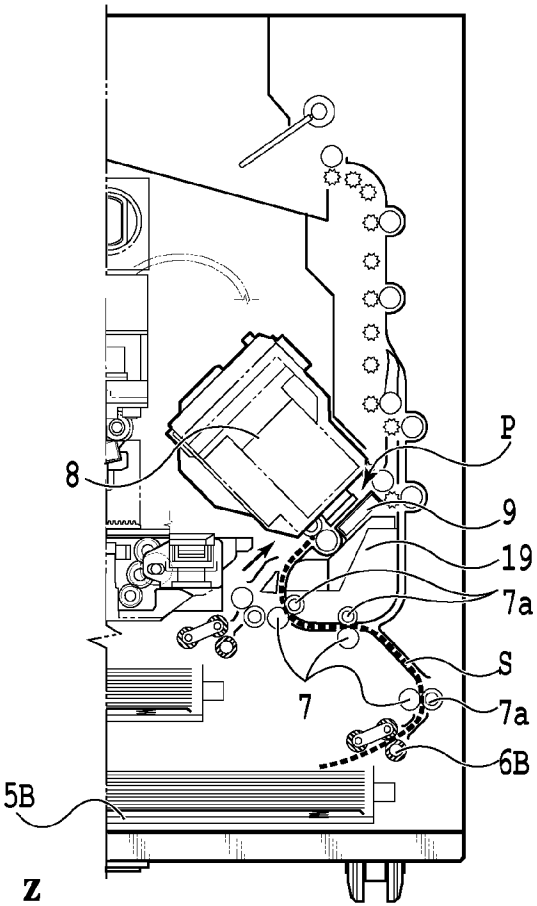

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
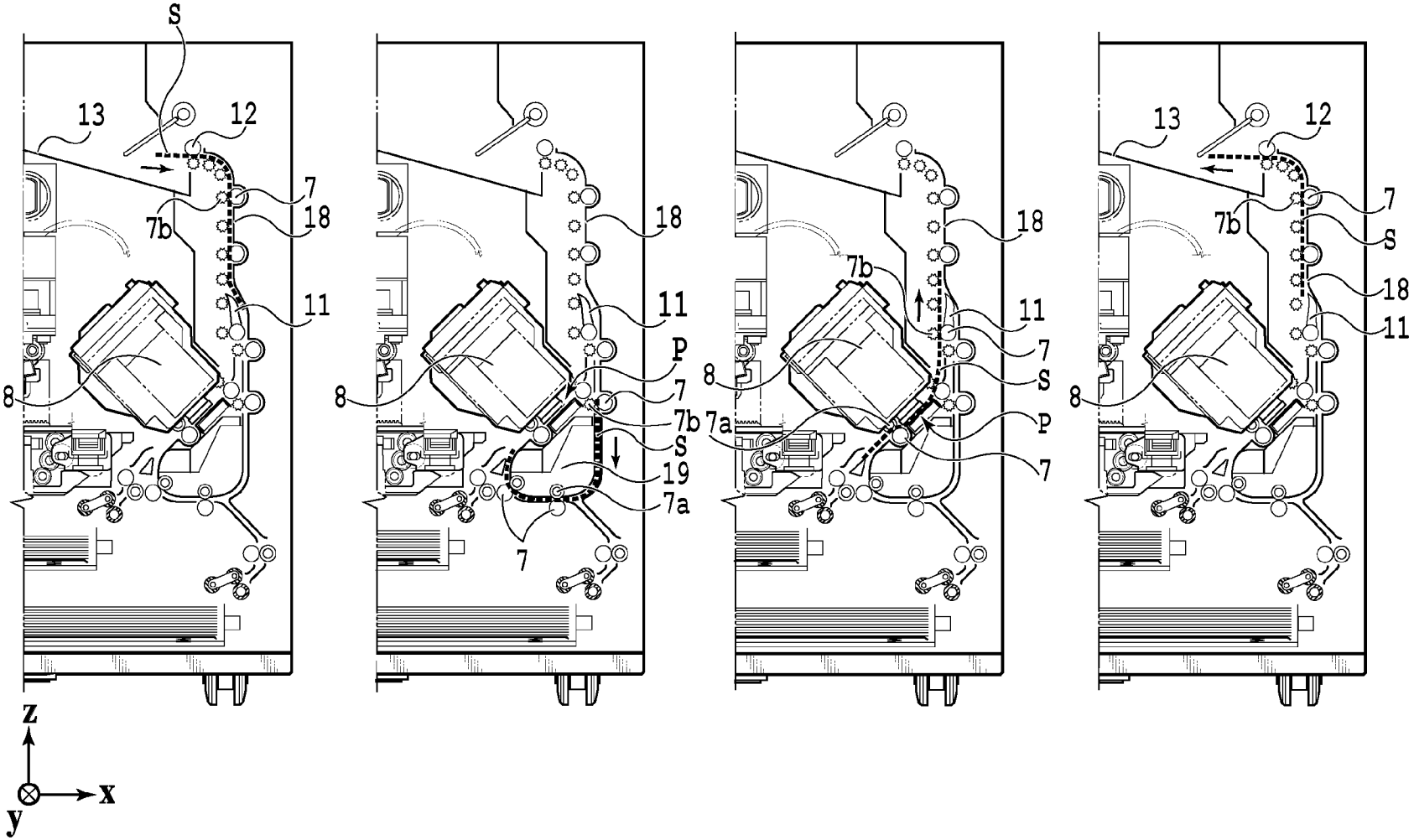
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
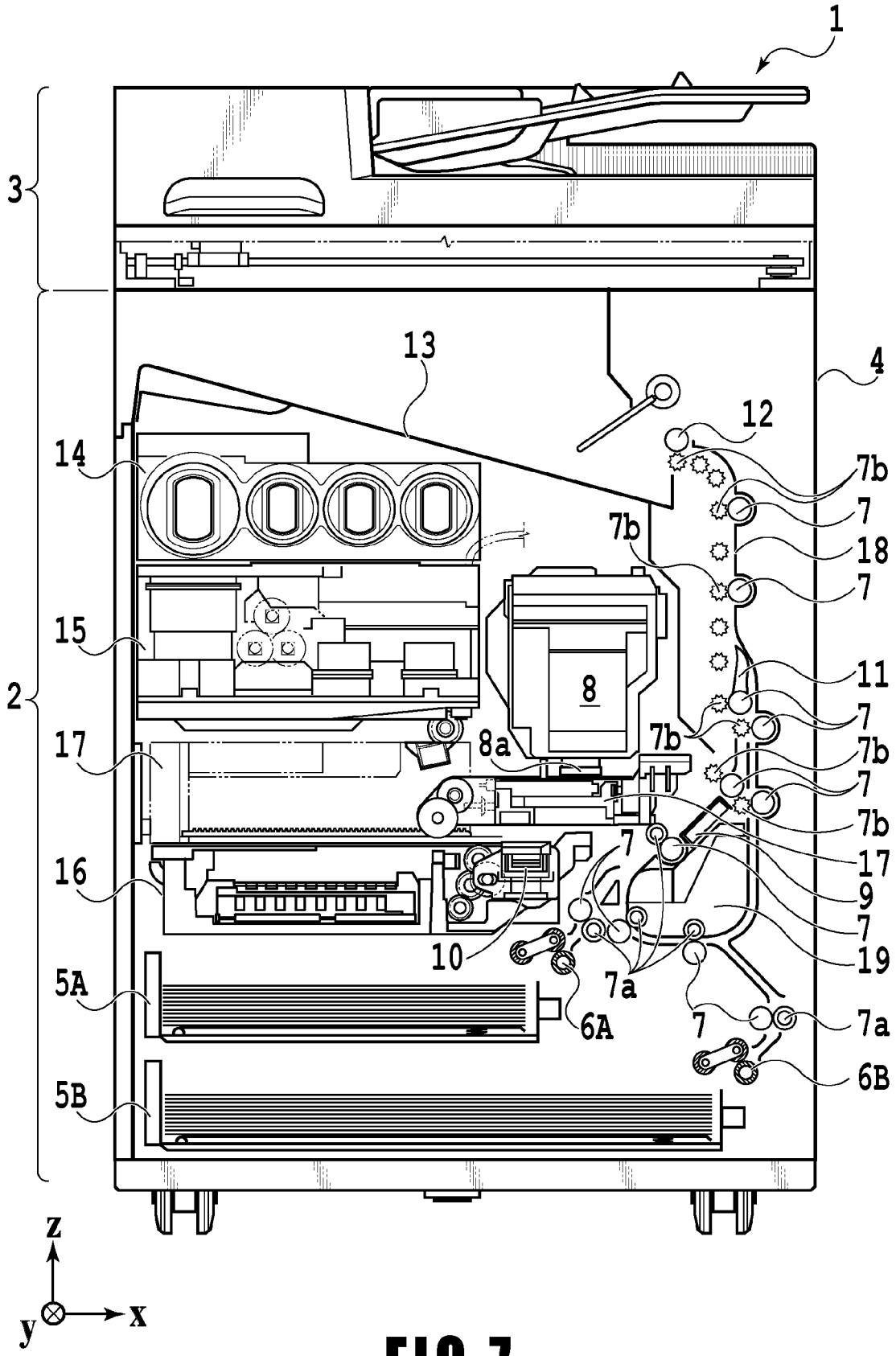
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
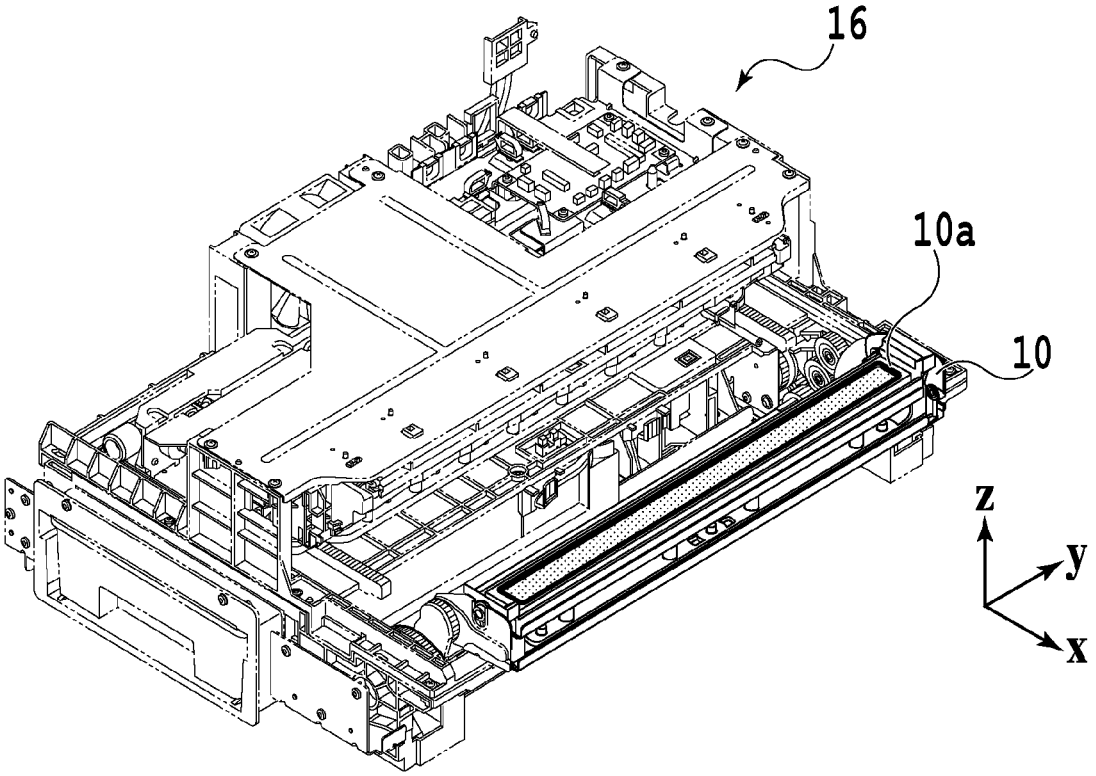
FIGS. 8A and 8B are perspective views showing the configuration of a maintenance unit.
Figure 8B:
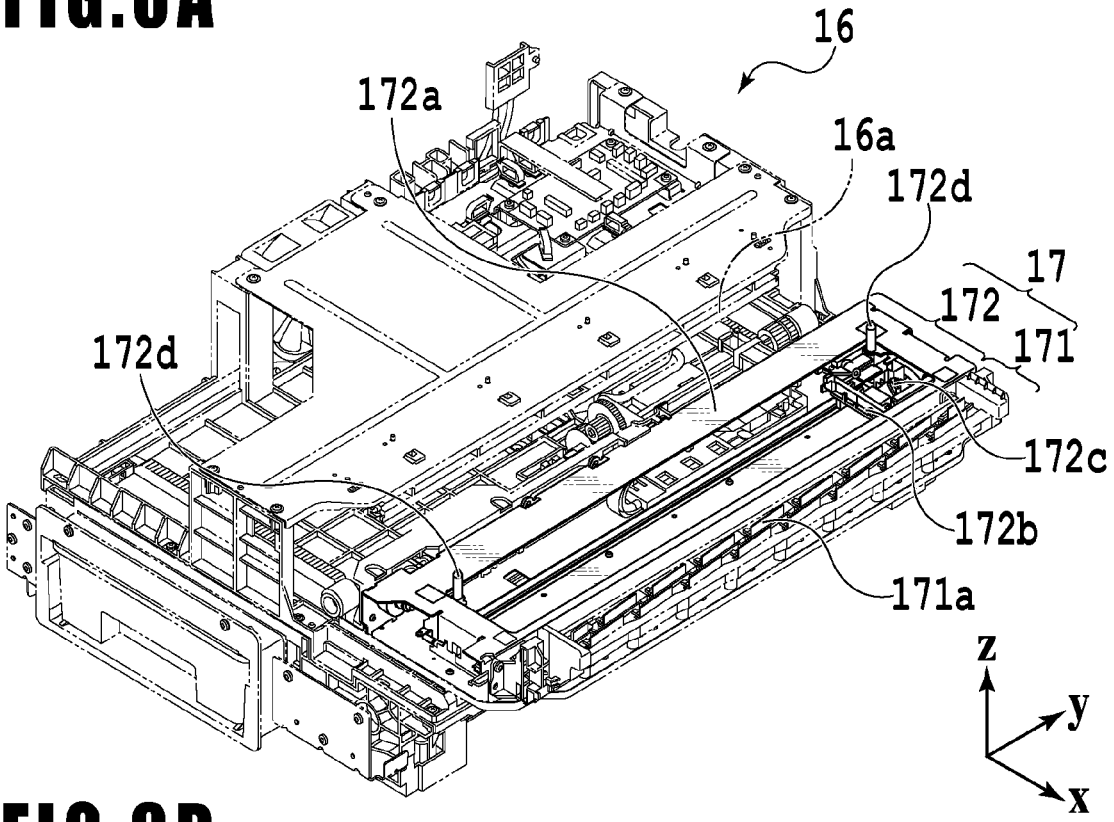

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink or the like adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member and suction operation of collected ink in the same manner as the first wiping process.

Next, description will be given of the details of the wet wiper cleaner 16*a* according to the present embodiment. The wetting liquid applied to the blade wipers 171*a* to improve sliding is hereinafter referred to as a treatment liquid or treatment agent. The treatment liquid includes water, glycerin, and alcohol. The treatment liquid has a function of dissolving ink thickening products or film thickening products accumulated on the ejection opening surface and a function of reducing abrasion of the blade wipers 171*a* and the like by increasing lubrication between the blade wipers 171*a* and the ejection opening surface. It also has a function of protecting the ejection opening surface by forming a film on the ejection opening surface, for example. The blade wiper unit 171 according to the present embodiment has a length corresponding to the length of the print head 8 in a longitudinal direction (a second direction) to wipe ink off on the ejection opening surface 8*a* of the print head 8. Furthermore, as shown in FIG. 8B, the blade wiper unit 171 has a plurality of blade wipers (wiping members) 171*a* aligned and arrayed in the longitudinal direction (the second direction) of the print head. In a case where the wiping unit 17 including the blade wiper unit 171 is driven in a direction in which it is housed in the maintenance unit 16, each blade wiper 171*a* comes into contact with the wet wiper cleaner 16*a*, whereby the treatment liquid is applied to each blade wiper 171*a*. The direction in which the wiping unit 17 is housed is also referred to as a first direction. Accordingly, the wet wiper cleaner 16*a* also has an elongated shape extending in the longitudinal direction (the second direction) of the print head 8. The first direction is a direction crossing the second direction.

Figures 9A, 9B, 9C, 9D:
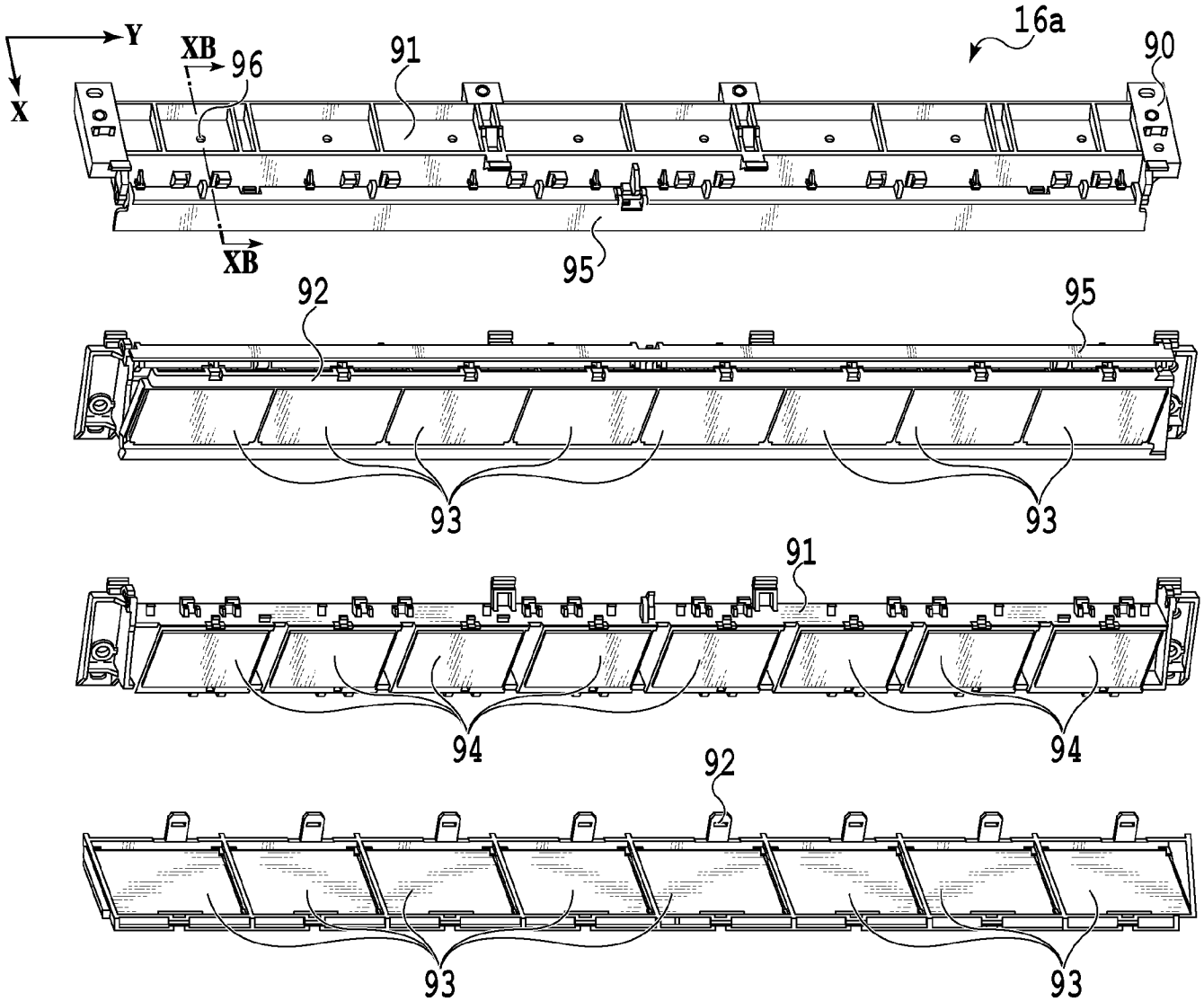
FIGS. 9A to 9D are perspective views of a treatment liquid holding unit.

FIGS. 9A to 9D are perspective views of a treatment liquid holding unit 90 which is an example of the wet wiper cleaner 16*a*. FIG. 9A is a perspective view of the treatment liquid holding unit 90 as viewed from an upper side in the vertical direction (i.e., an upper side in the z-direction of FIG. 1). FIG. 9B is a perspective view of the treatment liquid holding unit 90 as viewed from a lower side in the vertical direction (i.e., a lower side in the z-direction of FIG. 1). FIGS. 9C and 9D are perspective views of the treatment liquid holding unit 90 of FIG. 9B as disassembled.

The treatment liquid holding unit 90 has a treatment liquid holding case 91, a treatment liquid holding cover 92, a treatment liquid applying member 93, a treatment liquid holding member 94, and a wiper cleaner 95. On the treatment liquid holding case 91, there is formed a filling hole 96. The treatment liquid holding unit 90 has an elongated shape having its longitudinal dimension extending in the y-direction (the second direction). The y-direction (the second direction) in FIGS. 9A to 9D is a direction crossing a drive direction of the wiping unit 17 (a wiper drive direction, a wiper moving direction, the first direction). The y-direction (the direction crossing the wiper drive direction) is also a direction substantially identical with the longitudinal direction of the print head 8 in the maintenance position. The treatment liquid holding case 91 has a structure that the longitudinal dimension of the treatment liquid holding unit 90 is divided into a plurality of sections. As shown in FIG. 9C, in each section of the treatment liquid holding case 91, the treatment liquid holding member 94 is housed. The treatment liquid holding cover 92 also has a structure that the longitudinal dimension of the treatment liquid holding unit 90 is divided into a plurality of sections. As shown in FIG. 9D, in each section of the treatment liquid holding cover 92, the treatment liquid applying member 93 is mounted. The treatment liquid holding case 91 of FIG. 9C and the treatment liquid holding cover 92 of FIG. 9D are engaged and fixed, whereby the treatment liquid holding member 94 and the treatment liquid applying member 93 in each section are pressure welded to form the treatment liquid holding unit 90 as shown in FIG. 9B.

Figure 10A:
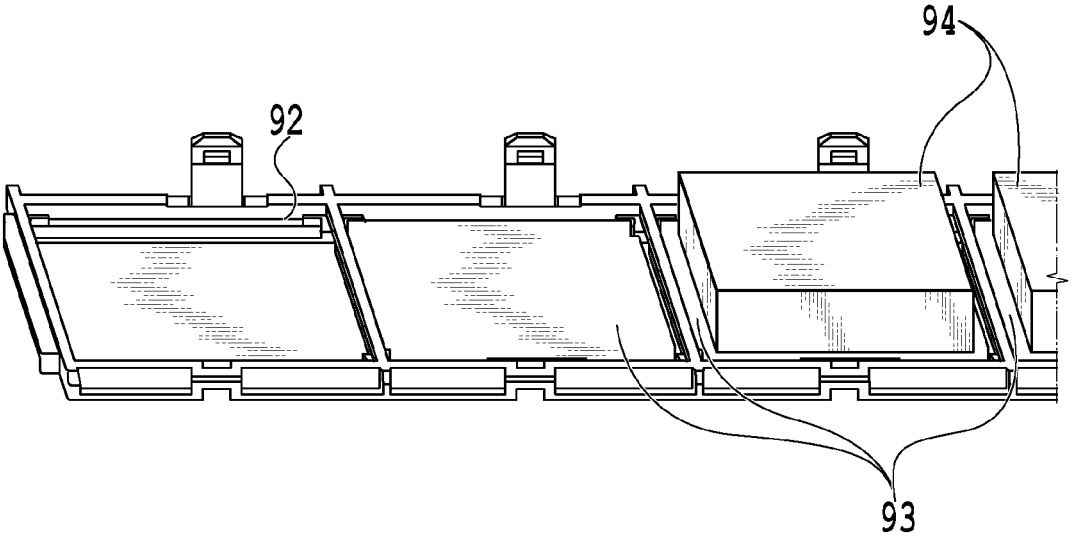
FIGS. 10A and 10B are diagrams illustrating the treatment liquid holding unit.
Figure 10B:
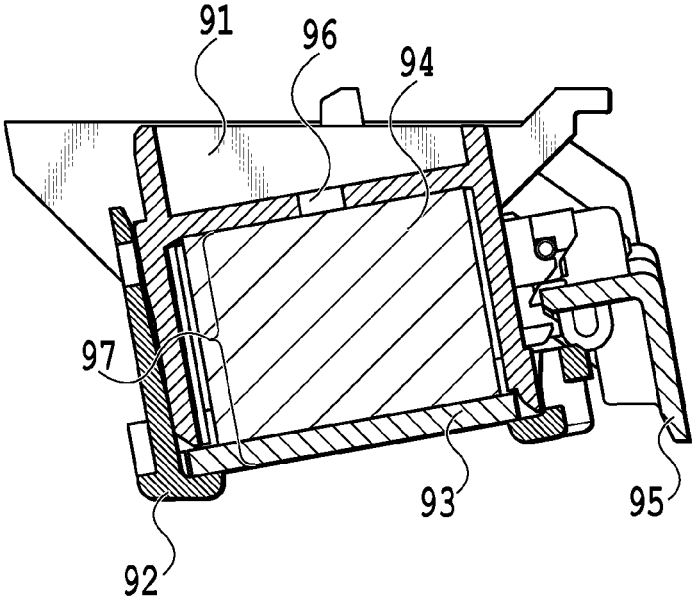

FIGS. 10A and 10B are diagrams illustrating the treatment liquid holding unit 90. FIG. 10A is a diagram showing an example of the mounting relation among the treatment liquid holding cover 92, the treatment liquid applying member 93, and the treatment liquid holding member 94. FIG. 10B is a cross section taken along line XB-XB of FIG. 9A. On the treatment liquid holding cover 92, the treatment liquid applying member 93 is mounted. Further, the treatment liquid applying member 93 is in contact (pressure welded) with the treatment liquid holding member 94. After the treatment liquid holding case 91 and the treatment liquid holding cover 92 are engaged, a treatment liquid is filled through the filling hole 96, and the treatment liquid is held in the treatment liquid holding member 94. Since the treatment liquid applying member 93 has a greater capillary force compared to the treatment liquid holding member 94, the treatment liquid penetrates and spreads to the treatment liquid applying member 93 from the treatment liquid holding member 94. The treatment liquid applying member 93 is made of a resin sintered body, for example. The treatment liquid holding member 94 is made of a polypropylene (PP) fiber nonwoven block, for example. Hereinafter, the treatment liquid holding member 94 and the treatment liquid applying member 93 housed in each section is collectively referred to as a treatment liquid holding portion 97.

As shown in FIGS. 9A to 9D and FIG. 10A, a plurality of treatment liquid holding portions 97 are aligned and arrayed in the longitudinal direction of the treatment liquid holding unit 90. The treatment liquid holding portions 97 are separated from each other by the treatment liquid holding case 91 and the treatment liquid holding cover 92, and the treatment liquid holding portions 97 are not in contact with each other. As used herein, "not in contact with each other" means separation between the treatment liquid holding portions 97 to an extent that a treatment liquid impregnated into one treatment liquid holding portion 97 does not penetrate through the other treatment liquid holding portion 97. The size of the section provided on the treatment liquid holding unit 90 is determined such that even if the treatment liquid holding unit 90 is left under predetermined environment conditions for a given time, the capillary forces of the treatment liquid holding member 94 and the treatment liquid applying member 93 do not cause the treatment liquid to leak. More specifically, even if the treatment liquid holding unit 90 is left under predetermined environment conditions for a given time in a position with a maximum pressure head of the treatment liquid held in the treatment liquid holding member 94, the treatment liquid does not leak. In the case of transport, component replacement, or the like, change in the longitudinal position of the treatment liquid holding portion having an elongated shape in the vertically upward or downward direction may cause the head to rise. As the head rises, the pressure head increases, thereby causing the treatment liquid to leak. The treatment liquid holding unit 90 is configured such that, although the treatment liquid holding unit 90 according to the present embodiment has an elongated shape, a plurality of sections are provided in the longitudinal direction (the direction crossing the wiper drive direction), and the treatment liquid holding portion 97 is housed in each of the sections. According to this configuration, it is possible to reduce the pressure head generated in each treatment liquid holding portion 97 housed in each section. Accordingly, it is possible to prevent leakage of the treatment liquid.

It should be noted that in the examples shown in FIGS. 9A to 9D, description has been given of the example of the aspect that the sections have substantially the same size and substantially the same shape. However, the present invention is not limited to this. Sections may have different sizes or shapes. Description will be given later of an example of the sections having different sizes or shapes.

Furthermore, in the present embodiment, description has been given of the example of the aspect that the treatment liquid holding portion 97 housed in each section is composed of one treatment liquid applying member 93 and one treatment liquid holding member 94. However, the present invention is not limited to this. For example, the treatment liquid holding portion 97 housed in one section may be composed of one treatment liquid applying member 93 and a plurality of treatment liquid holding members 94. In other words, the treatment liquid holding case 91 may have divider frames (not shown) for further dividing the section, and a treatment liquid holding member corresponding to the size of the divider frame may be housed. In this case, a plurality of treatment liquid holding members in one section are in contact (pressure welded) with one treatment liquid applying member 93 corresponding to the section.

Meanwhile, the treatment liquid holding portion 97 housed in one section may be composed of a plurality of treatment liquid applying members 93 and one treatment liquid holding member 94. Alternatively, the treatment liquid holding portion 97 housed in one section may be composed of a plurality of treatment liquid applying members 93 and a plurality of treatment liquid holding members 94. In all of the aspects, the treatment liquid holding portions 97 each composed of the treatment liquid applying member (s) 93 and the treatment liquid holding member(s) 94 corresponding to one section may be configured such that the treatment liquid holding portion 97 in one section and the treatment liquid holding portion 97 in another section do not come into contact with each other.

The sizes of frame portions of the treatment liquid holding case 91 and the treatment liquid holding cover 92 for making up a section may not be identical with each other. That is, for a given section, the size of the frame of the treatment liquid holding case 91 may be greater than the size of the frame of the treatment liquid holding cover 92 (that is, the size of a face of the treatment liquid holding member 94 being brought into contact may be greater than that of the treatment liquid applying member 93). In contrast, for a given section, the size of the frame of the treatment liquid holding case 91 may be smaller than the size of the frame of the treatment liquid holding cover 92 (that is, the size of a face of the treatment liquid holding member 94 being brought into contact may be smaller than that of the treatment liquid applying member 93). In both of the cases, the treatment liquid holding portions 97 each composed of the treatment liquid applying member 93 and the treatment liquid holding member 94 corresponding to one section may be configured such that the treatment liquid holding portion 97 in one section and the treatment liquid holding portion 97 in another section do not come into contact with each other.

The filling hole 96 is formed on the treatment liquid holding case 91 in a position corresponding to each section. As described above, the treatment liquid holding unit 90 is configured to have the treatment liquid holding portions 97 separately in the plurality of sections in the longitudinal direction. Accordingly, in a case where the treatment liquid is filled into the treatment liquid holding portion 97 (the treatment liquid holding member 94), the treatment liquid is filled into the treatment liquid holding portion 97 in each section. Therefore, the filling hole 96 is formed in the position corresponding to each section. The size and position of the filling hole 96 to be formed are not limited to those shown in the figure, but may be any position and size in each section.

The wiper cleaner 95 is provided extending in the longitudinal direction of the treatment liquid holding unit 90. By using the wiper cleaner 95, ink or the like adhering to the blade wipers 171*a* is removed.

Figure 11:
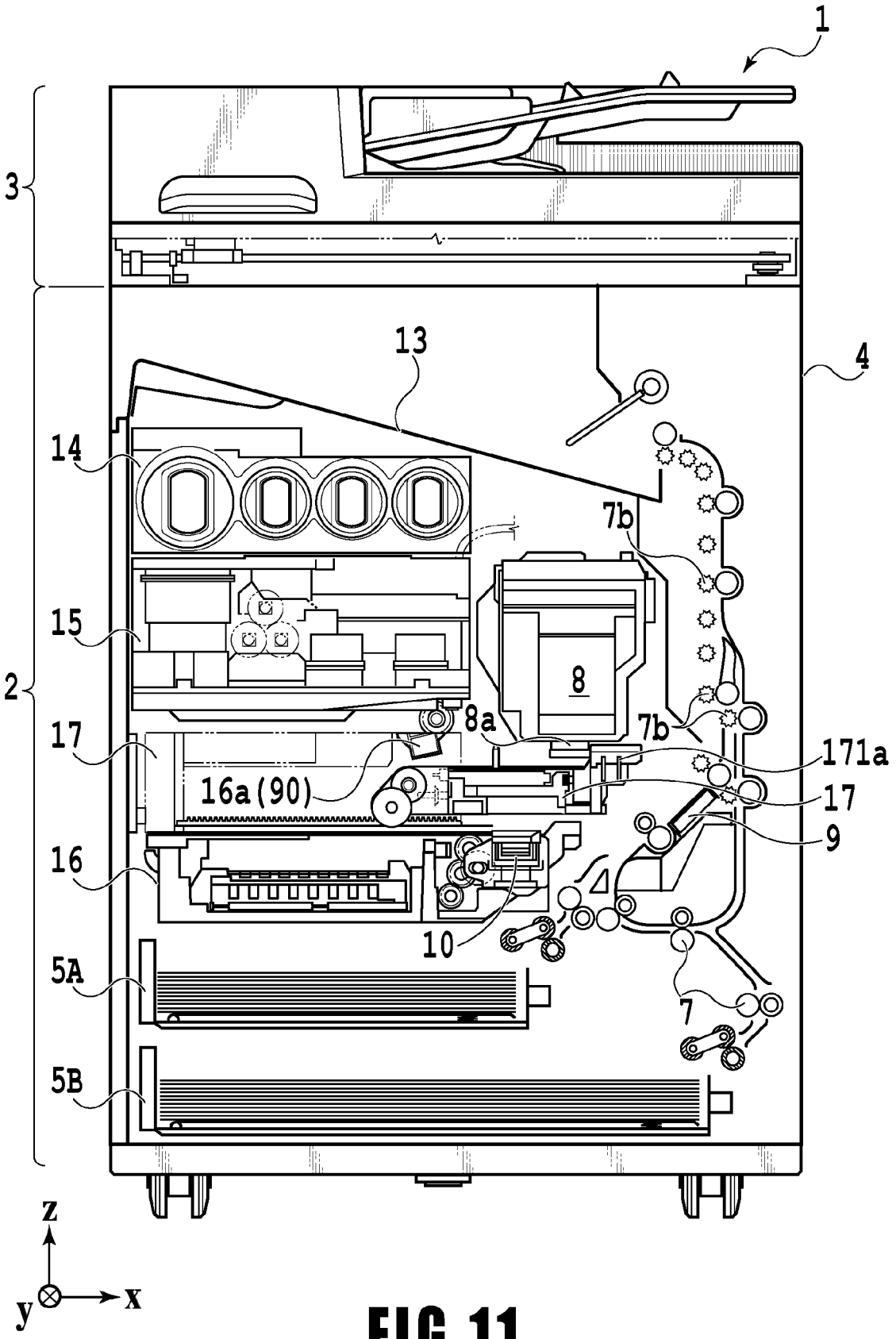
FIG. 11 is a diagram showing wiping operation performed by using a blade wiper unit.

FIG. 11 is a diagram showing wiping operation performed by the printing apparatus 1 using the blade wiper unit 171. FIG. 7 as described above is a diagram showing the wiping operation using the vacuum wiper unit 172. In FIG. 11, the print head 8 is located vertically upward as compared to FIG. 7 and the wiping unit 17 has slightly changed its position closer to an evacuation position as compared to FIG. 7. Upon receiving an instruction to perform wiping operation using the blade wiper unit 171, the print controller 202 controls the print head 8 and the wiping unit 17 to move to the positions shown in FIG. 11.

Description will be given of operation of moving the print head 8 from the standby position shown in FIG. 1 to a maintenance position shown in FIG. 11. The print controller 202 first controls the print head 8 to move in the vertically upward direction relative to the maintenance position shown in FIG. 11. The print controller 202 moves the cap unit 10 down and draws the wiping unit 17 from the maintenance unit 16 to the position shown in FIG. 11. Then, the print controller 202 moves the print head 8 down to the position shown in FIG. 11. After that, the print controller 202 moves the wiping unit 17 to be housed in the maintenance unit 16. Blade wiping is performed through this operation. Furthermore, in a case where the wiping unit 17 is housed in the maintenance unit 16, the treatment liquid is applied to the blade wipers 171*a* by the treatment liquid applying member 93 of the treatment liquid holding unit 90.

The blade wiping is executed in a case where print operation is performed on a predetermined number of print media S, for example, or based on an instruction from a user. The wiping unit 17 moves from the evacuation position shown in FIG. 1 to the position shown in FIG. 11 or moves from the position shown in FIG. 11 to the evacuation position shown in FIG. 1 by a drive mechanism (a moving unit), such as a motor (not shown), driven in accordance with the control by the print controller 202. In other words, the wiping unit 17 is driven in a lateral direction of the print head 8 in the maintenance position by the drive mechanism (not shown).

Figure 12:
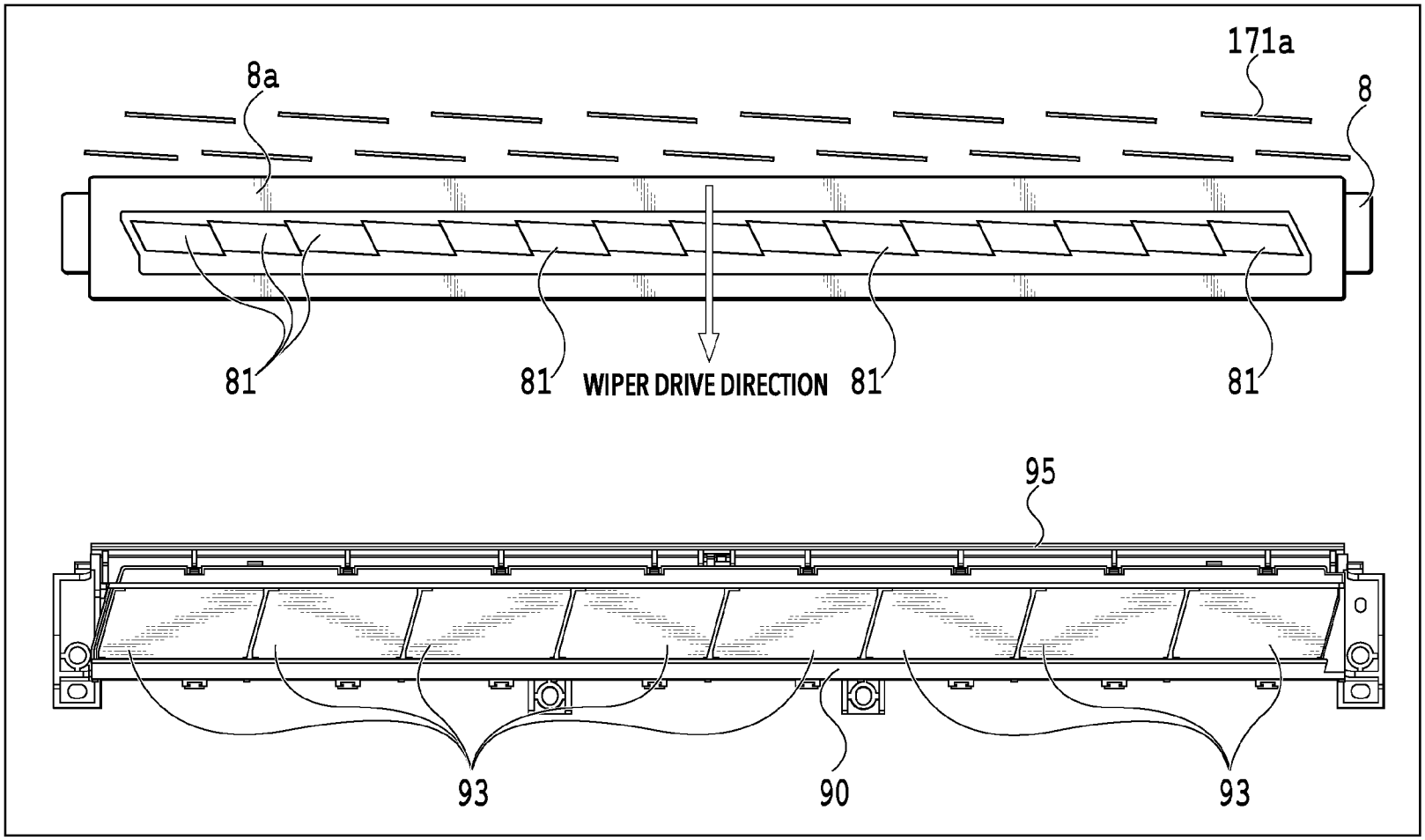
FIG. 12 is a diagram showing an ejection opening surface, blade wipers, and the treatment liquid holding unit.

FIG. 12 is a diagram showing the ejection opening surface 8*a* of the print head 8, the plurality of blade wipers 171*a* that wipe the ejection opening surface 8*a*, and the treatment liquid holding unit 90 in the positional relation shown in FIG. 11. FIG. 12 shows a state where the print head 8, the blade wiper unit 171, and the treatment liquid holding unit 90 are viewed from the bottom. It should be noted that for convenience in understanding, only the blade wipers 171*a* are illustrated as to the blade wiper unit 171, and the illustration of the other members is omitted. The drive mechanism (not shown) drives the blade wiper unit 171 in the wiper drive direction shown in FIG. 12, whereby cleaning operation is performed by the blade wipers 171*a* to wipe ink, paper dust, and the like off on the ejection opening surface 8*a* of the print head 8.

As shown in FIG. 12, in the present embodiment, the blade wiper unit 171 has the plurality of blade wipers (wiping members) 171*a*. The blade wipers 171*a* are aligned in the longitudinal direction of the print head 8 to form two staggered rows in the wiper drive direction. The blade wipers 171*a* are provided such that they partially overlap each other in the longitudinal direction of the print head 8. On the ejection opening surface 8*a* of the print head 8, a plurality of ejection units 81 each having a plurality of ejection openings for ejecting ink are arrayed. Each of the blade wipers 171*a* is provided in a position corresponding to each of the ejection units 81 in the longitudinal direction of the print head 8, and the longitudinal direction of the blade wipers 171*a* is inclined in accordance with the shape of the ejection units 81.

On the bottom surface of the treatment liquid holding unit 90, a plurality of treatment liquid applying members 93 are provided in the direction crossing the wiper drive direction such that they do not come into contact with each other. Further, as shown in FIG. 12, the adjacent treatment liquid applying members 93 are provided such that they partially overlap each other in the wiper drive direction. Details will be described later.

FIGS. 13A to 13E are diagrams showing the relation among the blade wiper 171*a*, the print head 8, and the treatment liquid holding unit 90 in a case where the wiping unit 17 is housed in the maintenance unit 16 from a wiping operation start position shown in FIG. 11. With reference to FIGS. 13A to 13E, description will be given of operation of applying the treatment liquid held in the treatment liquid holding unit 90 to the blade wipers 171*a* through the wiping of the print head 8.

Figure 13A:
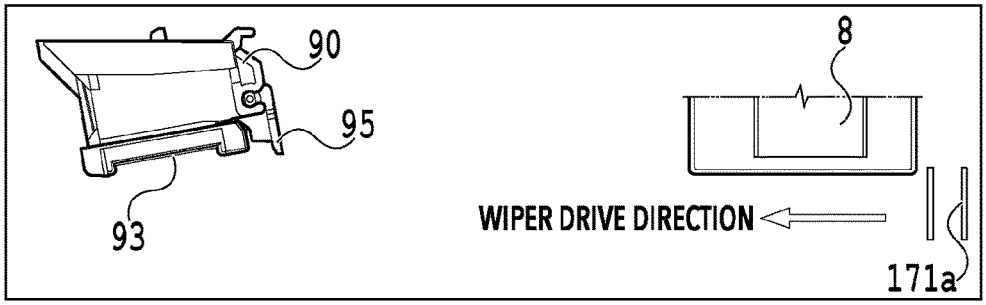
FIGS. 13A to 13E are diagrams showing the relation among the blade wiper, the print head, and the treatment liquid holding unit.
Figure 13B:
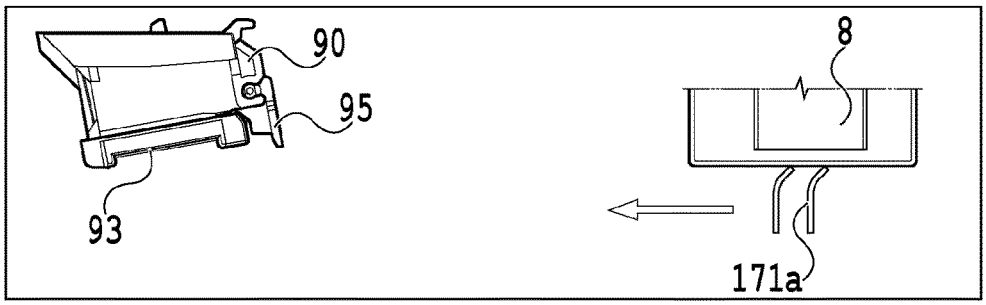
Figure 13C:
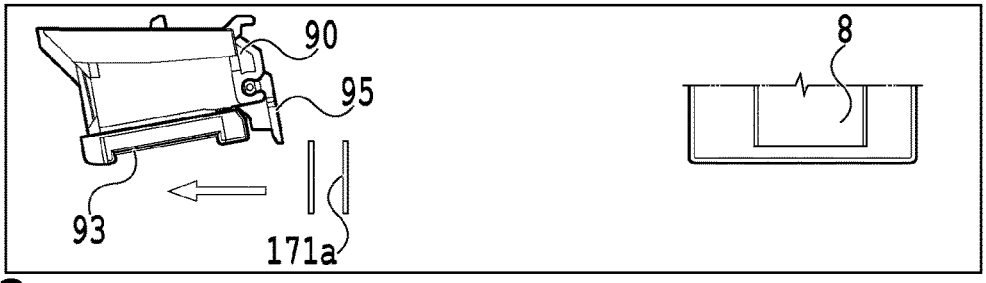
Figure 13D:
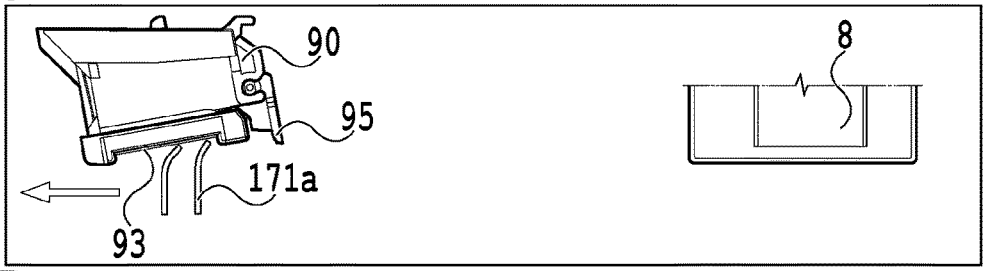
Figure 13E:
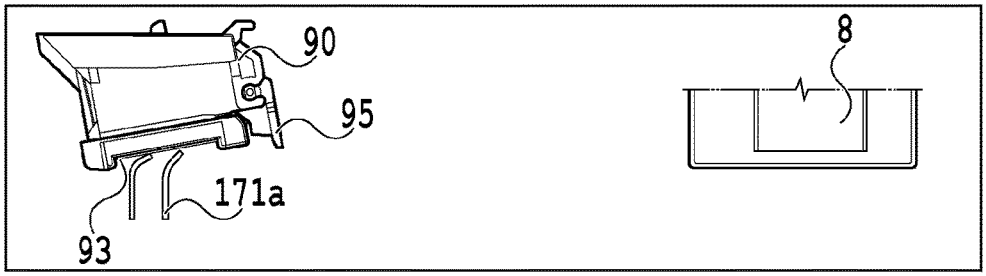

FIG. 13A is a diagram showing a state where the print head has moved down to the position shown in FIG. 11. The wiping unit 17 is driven in the wiper drive direction from this state, and then the blade wiper 171*a* is brought into contact (pressure contact) with the print head 8 as shown in FIG. 13B. The wiping unit 17 is further driven in the wiper drive direction, and the wiping of the print head 8 comes to an end. The wiping unit 17 is continuously driven in the wiper drive direction and comes close to the treatment liquid holding unit 90 as shown in FIG. 13C. After that, the wiping unit 17 is further driven in the wiper drive direction, and the blade wiper 171*a* is brought into contact (pressure contact) with the wiper cleaner 95. The ejection opening surface 8*a* is wiped, which allows ink, dust, or the like adhering to the blade wiper 171*a* to be scraped off by the wiper cleaner 95. Then, the wiping unit 17 is further driven in the wiper drive direction, and the blade wiper 171*a* comes into contact with the treatment liquid applying member 93. After that, the wiping unit 17 (the blade wiper 171*a*) moves to the position shown in FIG. 13E. While moving from the position shown in FIG. 13D to the position shown in FIG. 13E, the blade wiper 171*a* keeps contact with the treatment liquid applying member 93. That is, the blade wiper 171*a* is brought into sliding contact (pressure contact) with the treatment liquid applying member 93. While being in sliding contact, the treatment liquid is applied to the blade wiper 171*a* by the treatment liquid applying member 93.

Figure 14A:
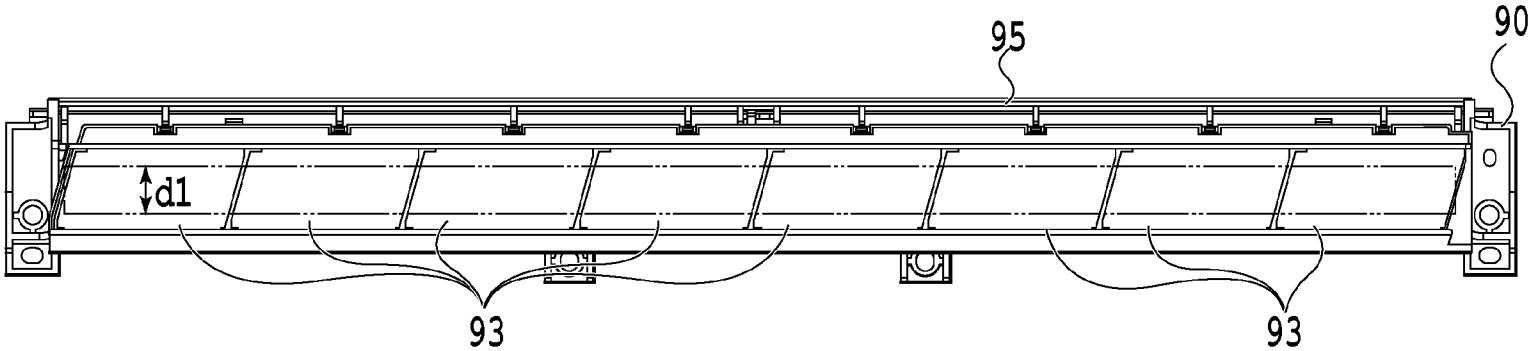
FIGS. 14A to 14C are diagrams illustrating a range in which the blade wiper is in contact with a treatment liquid applying member.
Figure 14B:
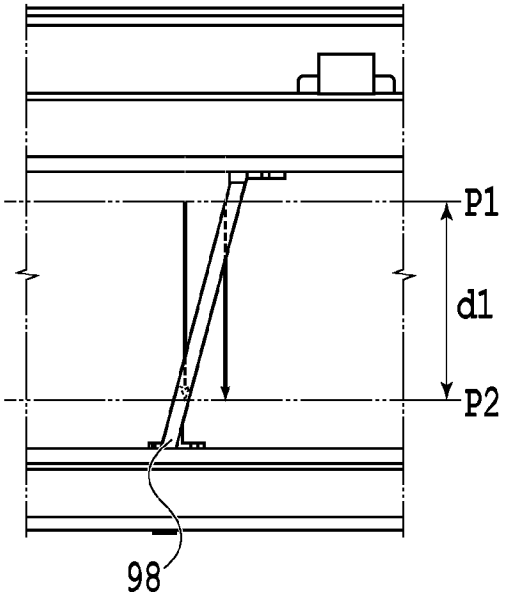
Figure 14C:
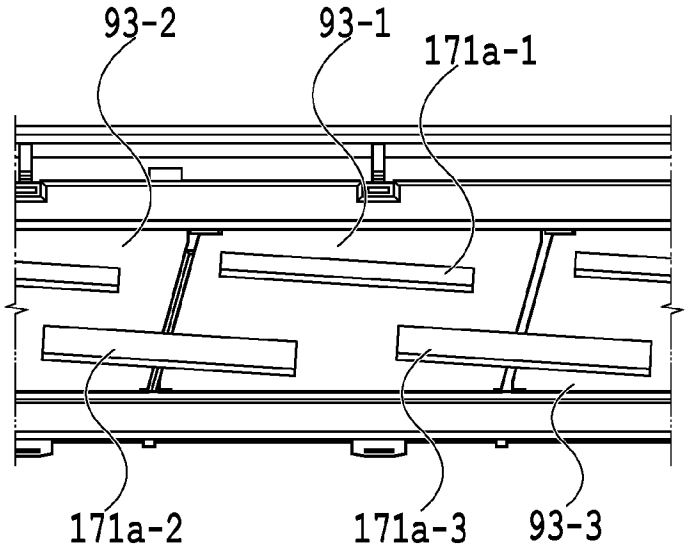

FIGS. 14A to 14C are diagrams illustrating a range in which the blade wiper 171*a* is in contact (sliding contact, pressure contact) with the treatment liquid applying member 93. FIG. 14A is a bottom view of the treatment liquid holding unit 90, and in a range d1 of the treatment liquid applying member 93, the blade wiper 171*a* comes into contact with the treatment liquid applying member 93. FIG. 14B is a partial enlarged view of FIG. 14A. The blade wiper 171*a* comes into contact with the treatment liquid applying member 93 in a position P1. The blade wiper 171*a* (the wiper unit 17) stops in a position P2.

As described above, the treatment liquid holding unit 90 according to the present embodiment is configured to have the treatment liquid holding portions 97 separately in the sections so that they do not come into contact with each other. Accordingly, as shown in FIG. 14B, the adjacent treatment liquid applying members 93 are separated from each other by a divider frame 98. The divider frame 98 is part of the treatment liquid holding cover 92. In a boundary area including the divider frame 98, no treatment liquid applying member 93 exists. This causes a phenomenon in which the treatment liquid is not applied to a contact area where the blade wiper 171*a* comes into contact with the divider frame 98. In the present embodiment, as shown in FIG. 14B, as viewed in the wiper drive direction from the area including the divider frame 98 formed in the direction crossing the wiper drive direction, the adjacent treatment liquid applying members 93 partially overlap each other in the wiper drive direction. The area including the divider frame 98 is an area including a boundary between the adjacent treatment liquid applying members 93. In FIG. 14B, a gap (the divider frame 98) between the adjacent treatment liquid applying members is inclined with respect to the wiper drive direction.

According to the above configuration, also in the area including the divider frame 98, the treatment liquid is applied to the blade wiper 171*a* by either of the adjacent treatment liquid applying members 93. Accordingly, it is possible to suppress occurrence of a portion in which the treatment liquid is not applied due to the divider frame 98. In FIG. 14B, although the treatment liquid is not applied to the blade wiper 171*a* in a portion indicated by dotted lines of arrows, the treatment liquid is applied to the blade wiper 171*a* in a portion indicated by solid lines of the arrows.

FIG. 14C is a diagram showing a situation that the blade wiper 171*a* is in contact with the treatment liquid applying member 93. A blade wiper 171*a*-1 comes into contact with a treatment liquid applying member 93-1, whereby the treatment liquid is applied. A blade wiper 171*a*-2 comes into contact with treatment liquid applying members 93-1 and 93-2, whereby the treatment liquid is applied. A blade wiper 171*a*-3 comes into contact with treatment liquid applying members 93-1 and 93-3, whereby the treatment liquid is applied.

As described above, according to the configuration of the present embodiment, it is possible to prevent leakage of the treatment liquid from the treatment liquid holding unit 90. It is also possible to suppress occurrence of an area where the treatment liquid is not applied to the blade wiper 171*a* (the wiping member).

Other Embodiments

In the above-described embodiment, description has been given of the example of the aspect that the plurality of blade wipers 171*a* (wiping members) are aligned and arranged in the longitudinal direction of the print head 8. However, the present invention is not limited to this aspect.

Figure 15:
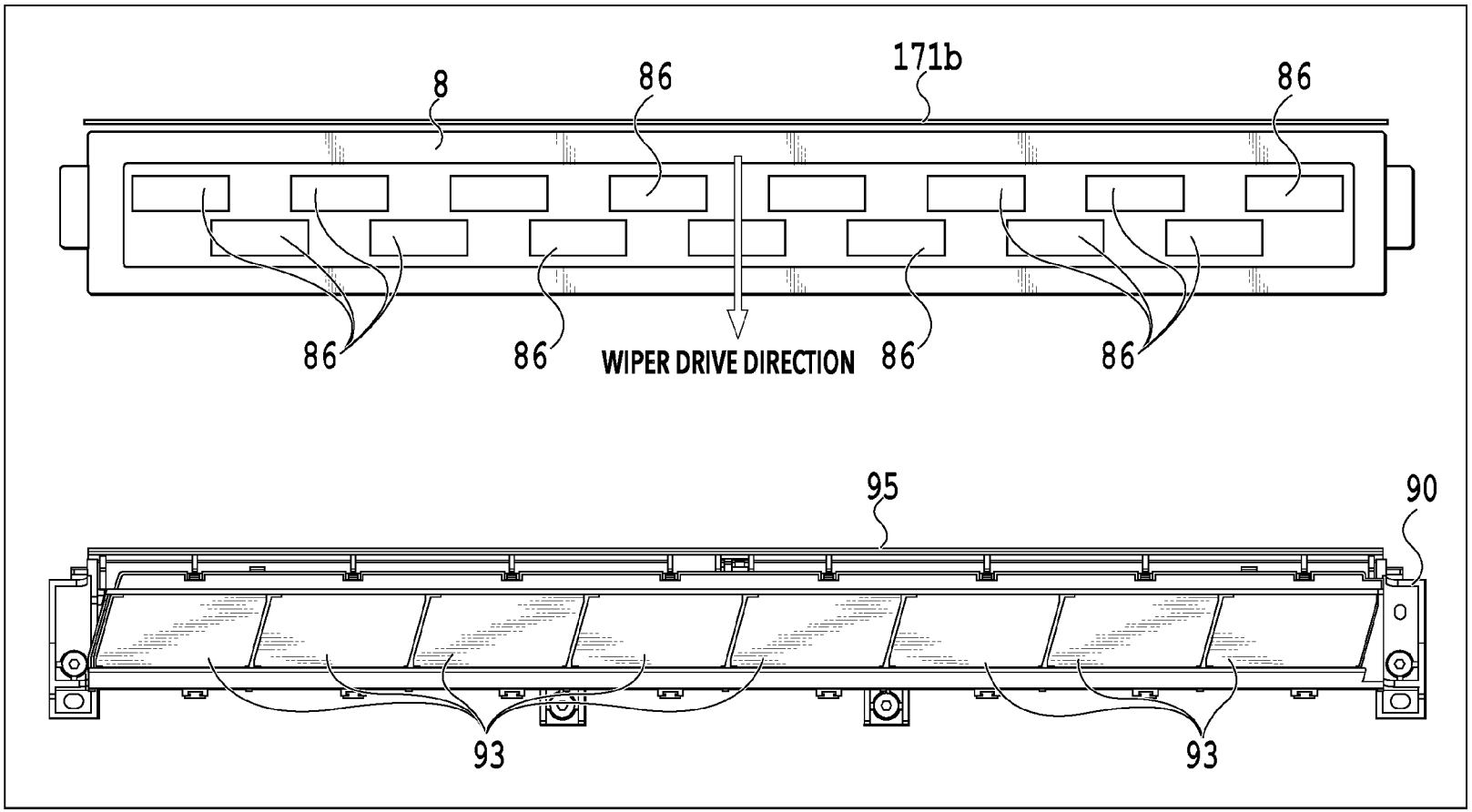
FIG. 15 is a diagram showing another embodiment of a wiping member.

FIG. 15 shows an aspect that the wiping member is made of one wiper 171*b*. On the ejection opening surface of the print head 8 of FIG. 15, ejection units 86 are configured to be staggered. Also in an embodiment using the print head 8 and the wiper 171*b* of this configuration, the same effect as the one described in the above embodiment can be obtained.

Figure 16A:
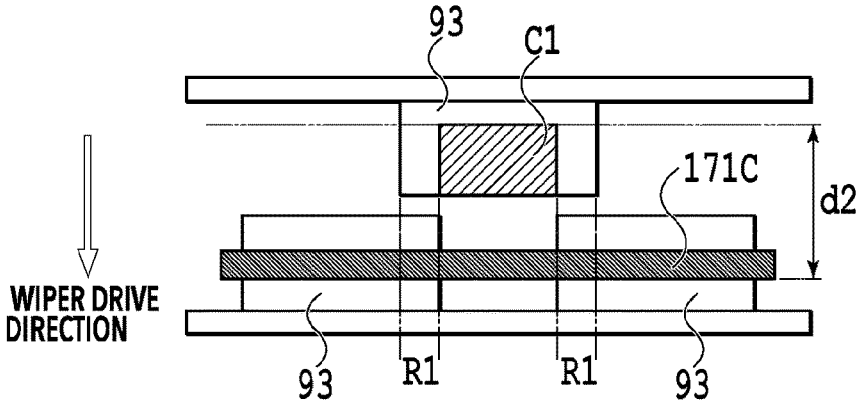
FIGS. 16A to 16E are diagrams showing the other embodiments of the treatment liquid applying member.

FIGS. 16A to 16E are diagrams showing the other embodiments of the treatment liquid applying member 93 that are different from the above-described embodiment. More specifically, the section in which the treatment liquid applying member 93 is mounted is different from the one in the above-described embodiment, and the shape of the treatment liquid applying member 93 as mounted is also different from the one in the above-described embodiment. FIG. 16A shows an example in which the sections of the treatment liquid applying members 93 are staggered. Also in the configuration shown in FIG. 16A, the plurality of treatment liquid applying members 93 are separately provided in the plurality of sections in the direction crossing the wiper drive direction. Furthermore, the adjacent treatment liquid applying members 93 are provided such that they partially overlap each other in a direction orthogonal to the wiper drive direction. A blade wiper 171*c* of FIG. 16A is in a position where it has stopped being driven in the wiper drive direction, and a range d2 shows a contact range of the blade wiper 171*c*. The adjacent treatment liquid applying members 93 have an overlapping range R1, which suppresses occurrence of a phenomenon in which the treatment liquid is not applied.

Figure 16B:
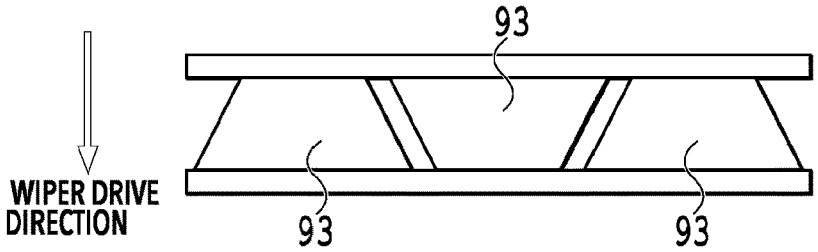
Figure 16C:
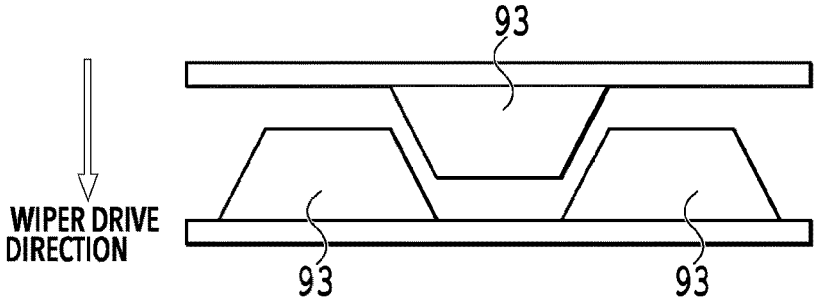
Figure 16D:
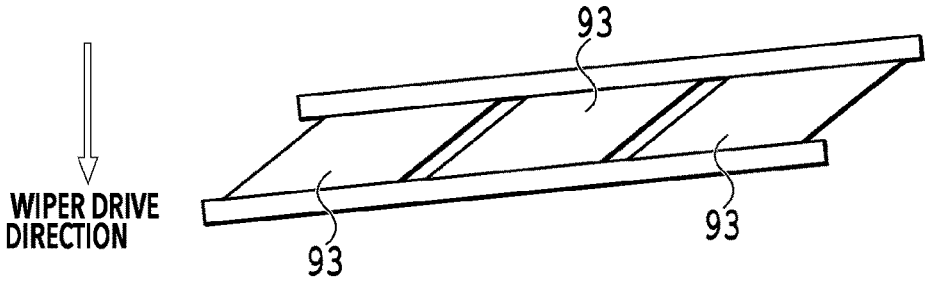
Figure 16E:
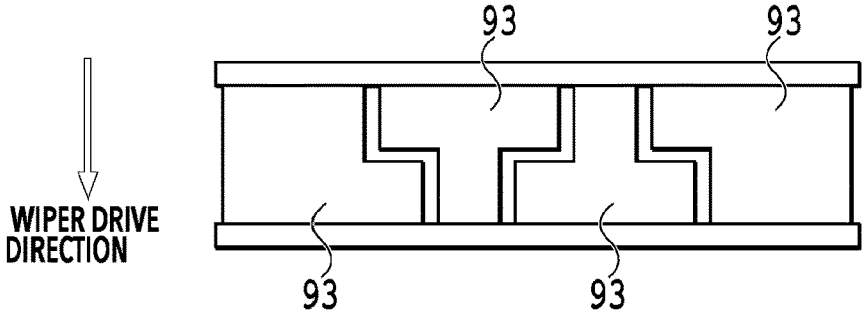

As shown in FIG. 16B, the sections of the treatment liquid applying members 93 may be trapezoids. As shown in FIG. 16C, the sections of the treatment liquid applying members 93 may be trapezoids and staggered. As shown in FIG. 16D, a surface shape of the sections of the treatment liquid applying members 93 may be inclined with respect to the wiper drive direction and arranged in parallel in the longitudinal direction of the treatment liquid holding unit 90. Furthermore, as shown in FIG. 16E, the sections of the treatment liquid applying members 93 may have different shapes and sizes depending on the sections.

In the configurations of FIGS. 16A to 16E, the treatment liquid applying members 93 having shapes according to the shapes of the sections are used. It should be noted that as for the treatment liquid holding members 94, they may be housed in the sections having the same shape and size as those shown in FIGS. 16A to 16E, respectively, or may be housed in the sections having different shapes and sizes from those shown in FIGS. 16A to 16E, respectively. That is, in the corresponding section, the shape or size for mounting the treatment liquid applying member 93 may be different from the shape or size for housing the treatment liquid holding member. The treatment liquid holding portions 97 (i.e., the treatment liquid holding portion 97 in each section) each composed of the treatment liquid holding member 94 and the treatment liquid applying member 93 may be configured such that they do not contact with each other.

Furthermore, in the above-described embodiment, as described with reference to FIG. 11, the wiping unit 17 is slid and drawn from the maintenance unit 16 in a state where the print head 8 is evacuated in the vertically upward direction. Description has been given of the aspect that after the print head 8 is moved vertically downward, the wiping unit 17 is moved into the maintenance unit 16, whereby wiping is performed. However, the present invention is not limited to this example. Wiping may also be performed such that after moving the print head 8 to the position where it can come into contact with the blade wipers 171*a*, the wiping unit 17 is slid and drawn from the maintenance unit 16. That is, wiping may be performed in the case of drawing the wiping unit 17. Then, the treatment liquid may be applied in a case where the print head 8 is evacuated in the vertically upward direction and the wiping unit 17 is drawn back to the maintenance unit 16.

Furthermore, description has been given of the aspect that in the printing apparatus 1 according to the above-described embodiment, the wiping unit 17 provided with the blade wipers 171*a* is driven to the left (that is, in the wiper drive direction) of FIG. 11, whereby the wiping operation is performed. However, the present invention is not limited to this. The print head may be driven in the wiper drive direction (or an opposite direction thereof) by a drive mechanism (not shown), whereby the wiping operation is performed. Alternatively, both of the wiping unit and the print head may be driven. That is, cleaning using a wiping member may be controlled by controlling a relative position between the wiping member and the print head in the lateral direction of the print head.

Furthermore, description has been given of the example of the aspect that in the printing apparatus 1 according to the above-described embodiment, the treatment liquid holding unit 90 is fixed and the wiping unit is driven, thereby applying the treatment liquid. However, the present invention is not limited to this. The treatment liquid holding unit (the treatment liquid holding portion) may be driven or both of the treatment liquid holding unit and the wiping unit may be driven. That is, control may be performed to bring the wiping member and the treatment liquid holding portion into contact with each other by controlling the movement of the wiping member and the treatment liquid holding unit and a relative position therebetween in the lateral direction of the print head.

Furthermore, in the above-described embodiment, description has been given of the example of the aspect that the plurality of ejection units are provided in the longitudinal direction of the print head. However, the present invention is not limited to this example. It is also assumed that a print head with a head width that is not that long is used such as a label printer. In such a case, it is possible to employ a configuration that the longitudinal direction and the lateral direction of the print head as described above are reversed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-091336, filed May 1, 2017, which is hereby incorporated by reference wherein in its entirety.

What is claimed is:

1. An inkjet printing apparatus comprising:

a print head having an ejection opening surface on which an ejection opening for ejecting ink is provided;

a wiping unit configured to wipe the ejection opening surface;

a moving unit configured to move the wiping unit in a first direction; and a plurality of treatment liquid holding portions each having a holding member for holding a treatment liquid and an applying member for applying the treatment liquid to the wiping unit by coming into contact with the wiping unit moved by the moving unit, the plurality of treatment liquid holding portions being arrayed in a second direction orthogonal to the first direction and a boundary between the adjacent applying members being inclined with respect to the first direction so that the adjacent applying members overlap each other in the second direction and in the first direction, wherein at least a part of the wiping unit is configured to have the treatment liquid applied from both of adjacent applying members by moving past the boundary in a case where the moving unit moves the wiping unit in the first direction.

2. The inkjet printing apparatus according to claim 1, wherein each treatment liquid holding portion of the plurality of treatment liquid holding portions is provided in a corresponding one of a plurality of sections separated in the second direction.

3. The inkjet printing apparatus according to claim 1, wherein a filling hole for filling a treatment liquid into the holding member is formed in a position corresponding to each of the treatment liquid holding portions.

4. The inkjet printing apparatus according to claim 1, wherein in each treatment liquid holding portion of the plurality of treatment liquid holding portions, the holding member and the applying member are in contact with each other.

5. The inkjet printing apparatus according to claim 1, wherein the applying member has a greater capillary force compared to the holding member.

6. A treatment liquid holding unit used for an inkjet printing apparatus including a print head having an ejection opening surface on which an ejection opening for ejecting ink is provided, a wiping unit configured to wipe the ejection opening surface, and a moving unit configured to move the wiping unit in a first direction, the treatment liquid holding unit comprising:

a plurality of treatment liquid holding portions each having a holding member for holding a treatment liquid and an applying member for applying the treatment liquid to the wiping unit by coming into contact with the wiping unit moved by the moving unit, the plurality of treatment liquid holding portions being arrayed in a second direction orthogonal to the first direction and a boundary between the adjacent applying members being inclined with respect to the first direction so that the adjacent applying members overlap each other in the second direction and in the first direction, wherein at least a part of the wiping unit is configured to have the treatment liquid applied from both of adjacent applying members by moving past the boundary in a case where the moving unit moves the wiping unit in the first direction.

7. The treatment liquid holding unit according to claim 6, wherein each treatment liquid holding portion of the plurality of treatment liquid holding portions is provided in a corresponding one of a plurality of sections separated in the second direction.

8. The inkjet printing apparatus according to claim 1, wherein the holding member is arranged above the applying member in the gravity direction.

9. The inkjet printing apparatus according to claim 1, wherein the print head is a line head having ejection openings corresponding to a width of a printing medium and the second direction corresponds to a longitudinal direction of the print head.

10. The treatment liquid holding unit according to claim 6, wherein the holding member is arranged above the applying member in the gravity direction.

11. The treatment liquid holding unit according to claim 6, wherein the print head is a line head having ejection openings corresponding to a width of a printing medium and the second direction corresponds to a longitudinal direction of the print head.

12. The inkjet printing apparatus according to claim 1, wherein the holding member and the applying member in each treatment liquid holding portion are housed in one compartment by a treatment liquid case.

13. The inkjet printing apparatus according to claim 1, wherein the wiping unit comprises a plurality of wiping members including a first wiping member and a second wiping member shifted from the first wiping member in the second direction, wherein the first wiping member is configured to have treatment liquid applied from a plurality of the applying members, and wherein the second wiping member is configured to have treatment liquid applied from a single applying member.

14. An inkjet printing apparatus comprising:

a print head having an ejection opening surface on which an ejection opening for ejecting ink is provided;

a wiping unit configured to wipe the ejection opening surface;

a moving unit configured to move the wiping unit in a first direction; and a plurality of treatment liquid holding portions each having a holding member for holding a treatment liquid and an applying member for applying the treatment liquid to the wiping unit by coming into contact with the wiping unit moved by the moving unit, wherein the plurality of treatment liquid holding portions is arrayed in spaced-apart positions in a second direction orthogonal to the first direction, with each treatment liquid holding portion being separated in the second direction from an adjacent treatment liquid holding portion by an inclined boundary between adjacent treatment liquid holding portions, wherein the inclined boundary between adjacent treatment liquid holding portions is inclined with respect to the first direction so that the adjacent treatment liquid holding portions overlap each other in the second direction and in the first direction, and wherein at least a part of the wiping unit is configured to have the treatment liquid applied from both of adjacent applying members by moving past the inclined boundary in a case where the moving unit moves the wiping unit in the first direction.

* * * * *